US008763707B2

(12) United States Patent
Williamson et al.

(10) Patent No.: US 8,763,707 B2
(45) Date of Patent: Jul. 1, 2014

(54) DOWNHOLE CIRCULATING VALVE HAVING A METAL-TO-METAL SEAL

(71) Applicant: Halliburton Energy Services, Inc., Houston, TX (US)

(72) Inventors: Jimmie Robert Williamson, Carrollton, TX (US); Leo G. Collins, Farmers Branch, TX (US); David L. Reesing, Irving, TX (US); Russell Irving Bayh, III, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 17 days.

(21) Appl. No.: 13/745,815

(22) Filed: Jan. 20, 2013

(65) Prior Publication Data

US 2013/0255934 A1 Oct. 3, 2013

(51) Int. Cl.
*E21B 34/06* (2006.01)

(52) U.S. Cl.
USPC ..... 166/330; 166/373; 166/386

(58) Field of Classification Search
USPC ..... 166/373, 386, 66.6, 330
See application file for complete search history.

(56) References Cited

U.S. PATENT DOCUMENTS

| | | | | |
|---|---|---|---|---|
| 3,581,820 | A * | 6/1971 | Burns | 166/330 |
| 3,901,315 | A * | 8/1975 | Parker et al. | 166/321 |
| 4,315,542 | A * | 2/1982 | Dockins, Jr. | 166/117.7 |
| 4,527,629 | A | 7/1985 | Whitley et al. | |
| 4,606,368 | A * | 8/1986 | McCafferty | 137/15.22 |
| 4,657,082 | A | 4/1987 | Ringgenberg | |
| 5,141,051 | A * | 8/1992 | Lenhart | 166/65.1 |
| 5,305,988 | A | 4/1994 | Cox | |
| 5,794,699 | A * | 8/1998 | Hammett et al. | 166/332.3 |
| 7,165,568 | B2 * | 1/2007 | Kessell et al. | 137/68.3 |
| 7,866,402 | B2 | 1/2011 | Williamson | |
| 2004/0041120 | A1 * | 3/2004 | Haughom et al. | 251/344 |
| 2009/0071658 | A1 * | 3/2009 | Reid et al. | 166/373 |

FOREIGN PATENT DOCUMENTS

WO 2008050116 5/2008

OTHER PUBLICATIONS

International Search Report and Written Opinion, US/2012/031956, KIPO, Jan. 2, 2013.

* cited by examiner

*Primary Examiner* — Giovanna Wright
*Assistant Examiner* — Kipp Wallace
(74) *Attorney, Agent, or Firm* — Lawrence R. Youst

(57) ABSTRACT

A downhole circulating valve includes a generally tubular outer housing having an axially extending internal passageway including an internal seat and at least one generally radially extending opening formed through the housing intersecting the internal seat. A valve element is rotatably disposed within the internal passageway. The valve element has an axially extending internal bore and a head portion disposed at least partially within the internal seat. The head portion includes at least one generally radially extending seal element. The valve element has a first position relative to the housing, wherein the seal element is not aligned with the opening, thereby allowing fluid communication between the opening and the internal passageway. The valve element has a second position relative to the housing, wherein the seal element is aligned with the opening and wherein the seal element forms a metal-to-metal seal with the internal seat, thereby preventing fluid communication between the opening and the internal passageway.

13 Claims, 6 Drawing Sheets

DOWNHOLE CIRCULATING VALVE HAVING A METAL-TO-METAL SEAL

CROSS-REFERENCE TO RELATED APPLICATIONS

This application claims the benefit under 35 U.S.C. §119 of the filing date of International Application No. PCT/US2012/031956, filed Apr. 3, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole circulating valve having a metal-to-metal seal in its non-circulating configuration and method for operating the downhole circulating valve between circulating and non-circulating configurations.

BACKGROUND OF THE INVENTION

Without limiting the scope of the present invention, its background will be described with reference to operations performed in a subterranean well that traverses a fluid-bearing subterranean formation, as an example. Subterranean wellbores are generally filled with fluids that extend from the lower end of the wellbore to the earth's surface. During drilling and completions operations, a weighted column of fluid is usually present adjacent to each of the fluid-bearing formations intersected by the wellbore, so that the column of fluid may exert hydrostatic pressure on the formations sufficient to prevent uncontrolled flow of fluid from the formations into the wellbore, which uncontrolled flow of fluid could result in a blowout.

In order to transport fluid, tools, instruments and the like within the wellbore, it is common practice to utilize a tubular string, such as drill pipe or production tubing, to which tools and instruments may be attached and within which fluid may be flowed and tools and instruments may be conveyed. When such a tubular string is disposed within the wellbore, the fluid column within the wellbore may be effectively divided into multiple portions. For example, a first fluid column may be contained in an annulus defined by the area separating the outside surface of the tubular string from the inside surface of the wellbore or casing string. At the same time, a second fluid column may be contained within the interior of the tubular string. In such a configuration, tools, instruments and the like may be transported within the wellbore attached to or within the tubular string without disturbing the relationship between the fluid column in the annulus and the fluid-bearing formations intersected by the wellbore.

After completing the well, it is typically desirable to remove the weighted column of fluid from both the interior of the tubular string, if present, and the annulus above the uppermost packer. This may be achieved through the use of a circulating valve disposed within in the tubular string, which has a primary purpose of selectively permitting fluid flow between the interior of the tubular string and the annulus. For example, when it is desired to remove the weighted column of fluid from the annulus, a lighter fluid may be pumped from the earth's surface down through the tubular string and radially outwardly from the tubular string through the circulating valve into the annulus and then back to the earth's surface up through the annulus. Typically, such tubing conveyed circulating valves have a sliding sleeve that may be longitudinally shifted between circulating and non-circulating positions using wireline or slickline techniques. In the non-circulating position, conventional circulating valves typically utilize resilient materials such as elastomers for sealing between movable metal parts to prevent fluid communication between the interior of the tubular string and the annulus.

It has been found, however, that resilient sealing materials may deteriorate due to the harsh chemical, physical and thermal environment downhole. When such deterioration occurs, the seals may fail to prevent fluid communication between the interior of the tubular string and the annulus when a conventional circulating valve is in its non-circulating configuration. Accordingly, a need has arisen for an improved circulating valve that is operable to selectively permit fluid flow between the interior of the tubular string and the annulus. In addition, a need has arisen for such an improved circulating valve that does not rely on resilient sealing materials to prevent fluid communication between the interior of the tubular string and the annulus when the circulating valve is in its non-circulating configuration.

SUMMARY OF THE INVENTION

The present invention disclosed herein comprises an improved circulating valve that is operable to selectively permit fluid flow between the interior of a tubular string and the annulus between the tubular string and the wellbore. In addition, the improved circulating valve of the present invention does not rely on resilient sealing materials to prevent fluid communication between the interior of the tubular string and the annulus when the circulating valve is in its non-circulating configuration but instead utilizes a metal-to-metal seal to provide a long lasting, high pressure seal.

In one aspect, the present invention is directed to a downhole circulating valve. The downhole circulating valve has a generally tubular outer housing having an axially extending internal passageway including an internal seat and at least one generally radially extending opening formed through the housing intersecting the internal seat. A valve element is rotatably disposed within the internal passageway. The valve element has an axially extending internal bore and a head portion disposed at least partially within the internal seat. The head portion includes at least one generally radially extending seal element. The valve element has a first position relative to the housing wherein the seal element is not aligned with the opening, thereby allowing fluid communication between the opening and the internal passageway. The valve element has a second position relative to the housing wherein the seal element is aligned with the opening and wherein the seal element forms a metal-to-metal seal with the internal seat, thereby preventing fluid communication between the opening and the internal passageway.

In one embodiment, the internal seat may have a spherical segment having a first radius. In this embodiment, the at least one generally radially extending opening may extend in the direction of the first radius. In some embodiments, an outer surface of the head portion may have a spherical segment having a second radius. In addition, the head portion may include at least one generally radially extending port that may extend in the direction of the second radius. The at least one generally radially extending seal element may also extend in the direction of the second radius. In certain embodiments, the first radius and the second radius may be sized to enable spherical mating of the at least one generally radially extending seal element and the internal seat. In such embodiments, the head portion may translate toward the internal seat when the valve element is operated from the first position to the second position to form the metal-to-metal seal. In one embodiment, the at least one generally radially extending seal element may include one or more seal rings each having a circular cross section.

In one embodiment, the housing may include a plurality of circumferentially distributed generally radially extending openings formed through the housing intersecting the internal seat. In this embodiment, the head portion may include a plurality of circumferentially distributed generally radially extending ports and a plurality of circumferentially distributed generally radially extending seal elements that are circumferentially offset from the ports such that in the first position, the ports are in fluid communication with the openings and, in the second position, each of the seal elements is aligned with one of the openings and forms a metal-to-metal seal with the internal seat.

In another aspect, the present invention is directed to a downhole circulating valve. The downhole circulating valve includes a generally tubular outer housing having an axially extending internal passageway including a spherical segment internal seat having a first radius and at least one generally radially extending opening formed through the housing intersecting the internal seat. A valve element is rotatably disposed within the internal passageway. The valve element has an axially extending internal bore and a head portion having an outer surface including a spherical segment with a second radius. The head portion is translatable relative to and disposed at least partially within the internal seat. The head portion includes at least one generally radially extending port and at least one generally radially extending seal element that is circumferentially offset from the port. The valve element has a first position relative to the housing wherein the port is in fluid communication with the opening and a second position relative to the housing wherein the seal element is aligned with the opening, wherein the seal element forms a metal-to-metal seal with the internal seat, wherein the first radius and the second radius are sized to enable spherical mating of the at least one generally radially extending seal element and the internal seat and wherein the head portion translates toward the internal seat when the valve element is operated from the first position to the second position.

In a further aspect, the present invention is directed to a downhole circulating system. The system includes a downhole power unit having an engagement assembly and a rotatable shaft. The system also includes a circulating valve having a generally tubular outer housing with an axially extending internal passageway including a profile, an internal seat and at least one generally radially extending opening formed through the housing intersecting the internal seat. A valve element is rotatably disposed within the internal passageway. The valve element has an axially extending internal bore with a profile and a head portion disposed at least partially within the internal seat. The head portion includes at least one generally radially extending seal element. A first portion of the engagement assembly is operably associated with the profile of the housing and a second portion of the engagement assembly is operably associated with the profile of the valve element such that when the downhole power unit is activated and the rotatable shaft is rotated, the valve element is rotatable between a first position relative to the housing wherein the seal element is not aligned with the opening and a second position relative to the housing wherein the seal element is aligned with the opening and wherein the seal element forms a metal-to-metal seal with the internal seat.

In an additional aspect, the present invention is directed to a method for operating a downhole circulating valve. The method includes providing a circulating valve having a generally tubular outer housing with an axially extending internal passageway including an internal seat and at least one generally radially extending opening formed through the housing intersecting the internal seat and a valve element rotatably disposed within the internal passageway, the valve element having an axially extending internal bore and a head portion disposed at least partially within the internal seat, the head portion including at least one seal element; running the circulating valve into a wellbore on a tubular string; running a rotating tool into the tubular string and engaging the circulating valve; and activating the rotating tool to rotate the valve element between a first position relative to the housing wherein the at least one seal element is not aligned with the at least one opening and a second position relative to the housing wherein the at least one seal element is aligned with the at least one opening and wherein the at least one seal element forms a metal-to-metal seal with the internal seat.

The method may also include running a downhole power unit having a rotatable shaft into the tubular string and engaging a profile of the housing and a profile of the valve element with the downhole power unit; activating an electric motor of the downhole power unit to impart rotary motion to the rotatable shaft; spherical mating the seal element and the internal seat by translating the head portion toward the internal seat and/or creating a metal-to-metal seal between at least one seal ring of the seal element and the internal seat.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
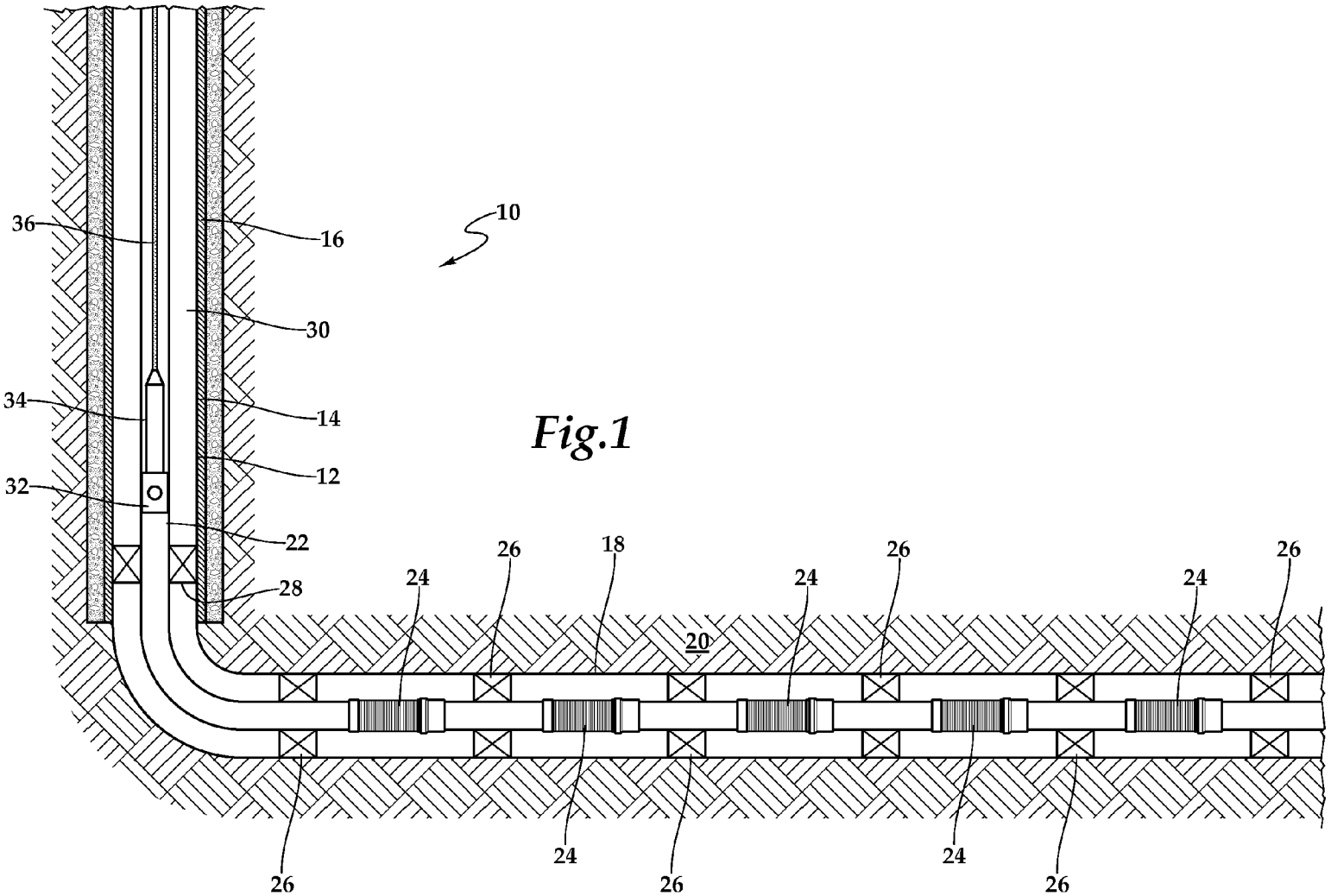
FIG. 1 is a schematic illustration of a well system operating a downhole circulating system according to an embodiment of the present invention.

Referring initially to FIG. 1, therein is depicted a well system including a downhole circulating system embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of sand control screens 24, each of which is positioned between a pair of annular barriers depicted as packers 26 that provides a fluid seal between the completion string and wellbore 12, thereby defining the production intervals. Tubing string 22 may include a variety of tools such as packer 28 that provides a seal between tubing string 22 and casing string 16. An annulus 30 is defined between tubing string 22 and casing string 16 above packer 28. As discussed above, during drilling and completions operations, a weighted column of fluid is usually present in the wellbore 12 to exert hydrostatic pressure on formation 20 sufficient to prevent uncontrolled flow of fluid from formation 20 into wellbore 12. To enable production, however, the weighted column of fluid must be removed from wellbore 12. In the illustrated embodiment, a circulating valve 32 is positioned within tubing string 22 above packer 28 and may be operated via a slickline or wireline deployed rotating tool depicted as downhole power unit 34. Circulating valve 32 serves the primary purpose of selectively permitting fluid flow between the interior of tubing string 22 and annulus 30.

For example, when it is desired to remove the weighted column of fluid from wellbore 12, downhole power unit 34 may be deployed via wireline 36 to engage with circulating valve 32. Typically, circulating valve 32 is initially run downhole in its non-circulating configuration to prevent fluid flow between the interior of tubing string 22 and annulus 30. Once engaged, downhole power unit 34 may be activated to operate circulating valve 32 from its non-circulating configuration to its circulating configuration. Thereafter, a lighter fluid may be pumped from the earth's surface down through tubing string 22 and radially outwardly from tubing string 22 through circulating valve 32 into annulus 30 and then back to the earth's surface up through annulus 30. After the weighted column of fluid is removed, downhole power unit 34 may be activated to operate circulating valve 32 from its circulating configuration to its non-circulating configuration. In the present invention, when circulating valve 32 is in its non-circulating configuration, one or more metal-to-metal seals prevent fluid communication between the interior of tubing string 22 and annulus 30.

Even though FIG. 1 depicts the circulating valve of the present invention in a cased hole environment, it should be understood by those skilled in the art that the present invention is equally well suited for use in an open hole well. In addition, even though FIG. 1 depicts the circulating valve of the present invention in a vertical section of the wellbore, it should be understood by those skilled in the art that the present invention is equally well suited for use in wells having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring next to FIGS. 2A-2E, therein is depicted successive axial sections of a downhole circulating system embodying principles of the present invention that is representatively illustrated and generally designated 100. System 100 includes a rotating tool depicted as downhole power unit 102 and a circulating valve 104 that may be deployed in a well system as part of the tubing string as described above. Downhole power unit 102 includes a housing assembly 106 that comprises suitably shaped and connected generally tubular housing members. An upper portion of housing assembly 106 includes an appropriate mechanism to facilitate coupling of housing 106 to a conveyance such as a wireline, slickline, electric line, coiled tubing, jointed tubing or the like.

In the illustrated embodiment, downhole power unit 102 includes a self-contained power source, eliminating the need for power to be supplied from an exterior source, such as a source at the surface, however, in other embodiments, power may be provided to downhole power unit 102 from the surface via a wired connection. A preferred power source comprises a battery assembly 108 which may include a plurality of batteries such as alkaline batteries, lithium batteries or the like. Downhole power unit 102 also has a force generating and transmitting assembly 110 that preferably includes a direct current electric motor and a gearbox. The electric motor may be of any suitable type. One example is a motor operating at 7500 revolutions per minute in unloaded condition, and operating at approximately 5000 rpm in a loaded condition, and having a horsepower rating of approximately 1/30th of a horsepower. In this implementation, the electric motor may be coupled through a gearbox, which provides approximately 5000:1 gear reduction to a sleeve assembly 112, which is in turn coupled to a rotatable shaft 114. Downhole power unit 102 may include a variety of sensors and controllers that are operable to activate and deactivate downhole power unit 102 including, but not limited to, a microcontroller, a pressure-sensitive switch, an accelerometer, a geophone or the like. Alternatively or additionally, downhole power unit 102 may be controlled from the surface via wired or wireless communications.

At its lower end, housing assembly 106 includes an engagement assembly 116. In the illustrated embodiment, engagement assembly 116 includes a set of locating keys 118, a set of anti-rotation keys 120 and a set of torque keys 122. Preferably, anti-rotation keys 120 and torque keys 122 are rotatable relative to locating keys 118. In addition, torque keys 122 are rotatable relative to anti-rotation keys 120. Torque keys 122 are operably associated with rotatable shaft 114 such that when rotatable shaft 114 is rotated, torque keys 122 are rotated therewith.

Figure 3:
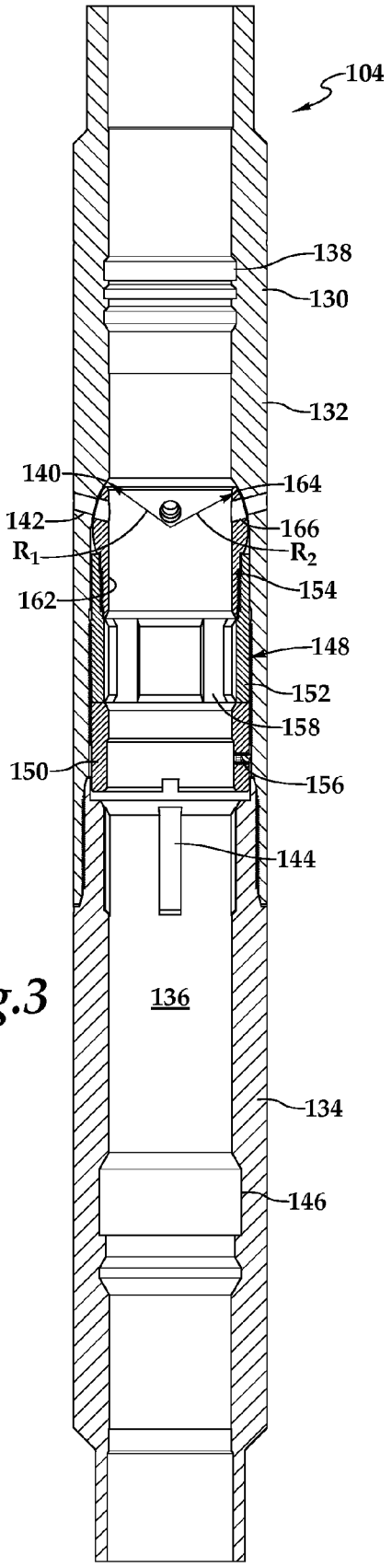
FIG. 3 is a cross sectional view of a downhole circulating valve according to an embodiment of the present invention in its circulating configuration.
Figure 4:
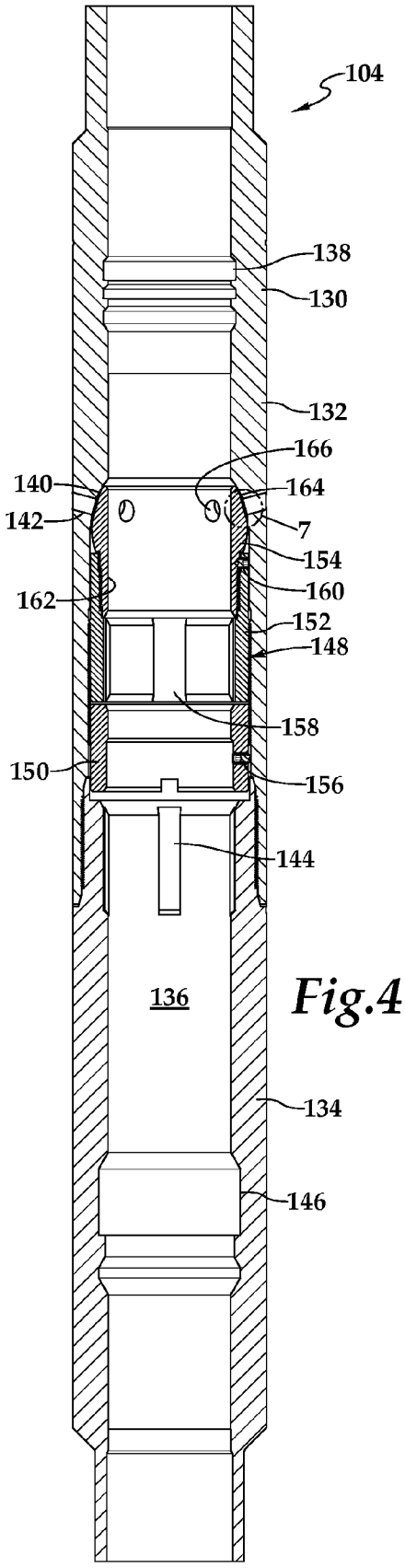
FIG. 4 is a cross sectional view of a downhole circulating valve according to an embodiment of the present invention in its non-circulating configuration.

Referring additionally now to FIGS. 3 and 4, circulating valve 104 will now be described. Circulating valve 104 has a generally tubular outer housing 130 including, in the illustrated embodiment, an upper housing section 132 and a lower housing section 134 that are threadably coupled together. Housing 130 defines an axially extending internal passageway 136. Upper housing section 132 includes a locating profile 138. Upper housing section 132 also includes an internal seat depicted as a spherical segment internal seat 140 having a radius R1, as best seen in FIG. 3. Upper housing section 132 further includes four generally radially extending openings 142 (only two such openings being visible in the figures) formed through upper housing section 132 intersecting internal seat 140. Preferably, openings 142 radially extend through upper housing section 132 in the direction of radius R1. Even though upper housing section 132 has been described as having a particular number of openings 142, other numbers of openings both greater than four and less than four including one opening could alternatively be formed through upper housing section 132 without departing from the principles of the present invention. Lower housing section 134 includes an anti-rotation profile depicted as plurality of circumferentially distributed slots 144 and a locating profile 146.

Circulating valve 104 includes a valve element 148. In the illustrated embodiment, valve element 148 includes a lower valve section 150, an upper valve section 152 and a head portion 154. Lower valve section 150 is threadably coupled to upper housing section 132 and is secured against rotation relative to upper housing section 132 by one or more set screws 156. Upper valve section 152 is also threadably coupled to upper housing section 132 but is free to rotate relative to upper housing section 132 between two stopping points as described below. Upper valve section 152 includes a rotation profile depicted as plurality of circumferentially distributed slots 158. Head portion 154 is threadably coupled to upper valve section 152 and is secured against rotation relative to upper valve section 152 by one or more set screws 160. As such, upper valve section 152 and head portion 154 are operable to rotate together relative to upper housing section 132. In addition, due to the threaded engagement between upper valve section 152 and upper housing section 132, rotation of upper valve section 152 and head portion 154 relative to upper housing section 132 causes upper valve section 152 and head portion 154 to translate longitudinally relative to upper housing section 132. The extent of downward longitudinally travels of upper valve section 152 and head portion 154 is limited by contact between an upper valve section 152 and lower valve section 150. The extent of upward longitudinally travel of upper valve section 152 and head portion 154 is limited by contact between head portion 154 and internal seat 140, as more fully described below.

Valve element 148 has an axially extending internal bore 162. Head portion 154 has an outer surface including a spherical segment 164 with a radius R2, as best seen in FIG. 3. Head portion 154 includes four generally radially extending ports 166 (only some of the ports being visible in the figures). Preferably, ports 166 radially extend through head portion 154 in the direction of radius R2. Even though head portion 154 has been described as having a particular number of ports 166, other numbers of ports both greater than four and less than four including one port could alternatively be formed through head portion 154 without departing from the principles of the present invention. Also, even though head portion 154 has been described as having the same number of ports 166 as upper housing section 132 has openings 142, this is not required by the present invention.

Figure 5:
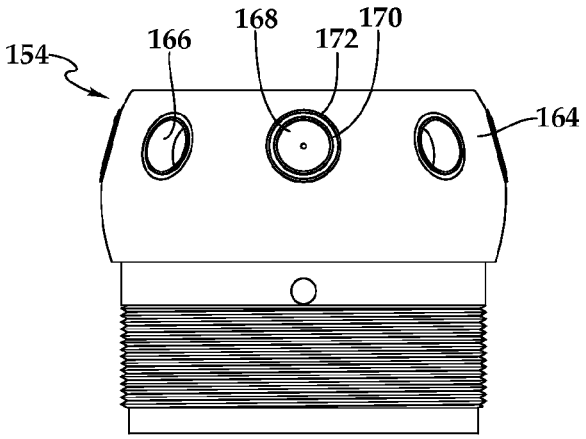
FIG. 5 is a side view of a head portion of a valve element of a downhole circulating valve according to an embodiment of the present invention.
Figure 6:
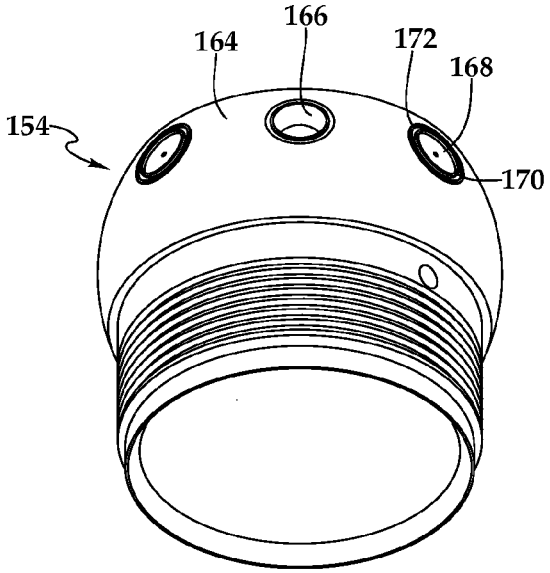
FIG. 6 is a perspective view of a head portion of a valve element of a downhole circulating valve according to an embodiment of the present invention.
Figure 7:
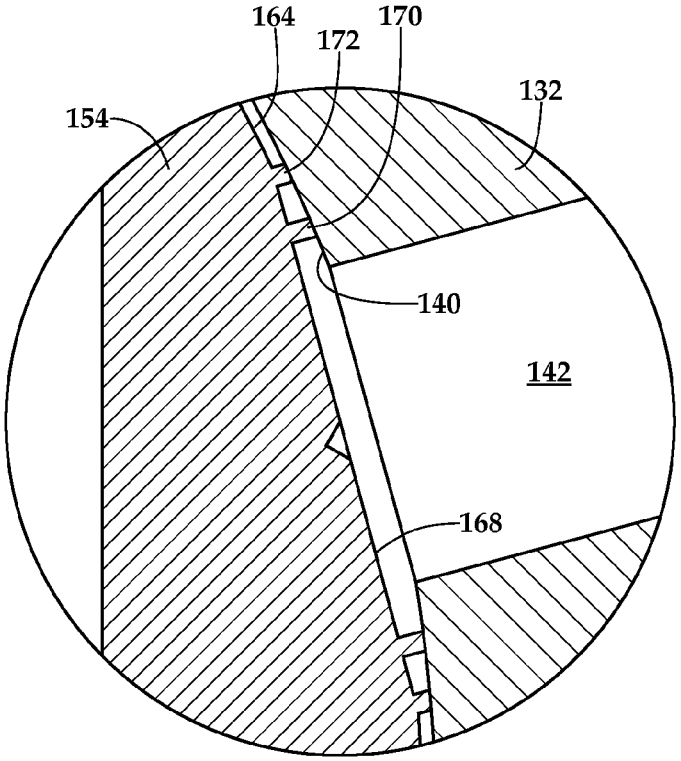
FIG. 7 is an enlarged view of a metal-to-metal seal formed within a downhole circulating valve in its non-circulating configuration according to an embodiment of the present invention.

As best seen in FIGS. 5-7, head portion 154 also includes four generally radially extending seal elements 168 (only some of the seal elements being visible in the figures). Preferably, seal elements 168 radially extend from head portion 154 in the direction of radius R2. Even though head portion 154 has been described as having a particular number of seal elements 168, other numbers of seal elements both greater than four and less than four including one seal element could alternatively be formed on head portion 154 without departing from the principles of the present invention, however, the number of seal elements 168 should equal or exceed the number of openings 142 through upper housing section 132. As illustrated, ports 166 and seal elements 168 are circumferentially distributed about head portion 154 at a uniform interval of 45 degrees with a port 166 positioned between each pair of seal elements 168 and a seal element 168 positioned between each pair of ports 166.

In the illustrated embodiment, seal elements 168 include a pair of concentric seal rings 170, 172, each having a circular cross section. Preferably, seal rings 170, 172 radially extend from head portion 154 in the direction of radius R2. As such, the outer surfaces of seal rings 170, 172 lie in a spherical segment that has a radius that enables spherical mating between the outer surfaces of seal rings 170, 172 and internal seat 140 when circulating valve 104 is in its non-circulating configuration.

Figure 2A:
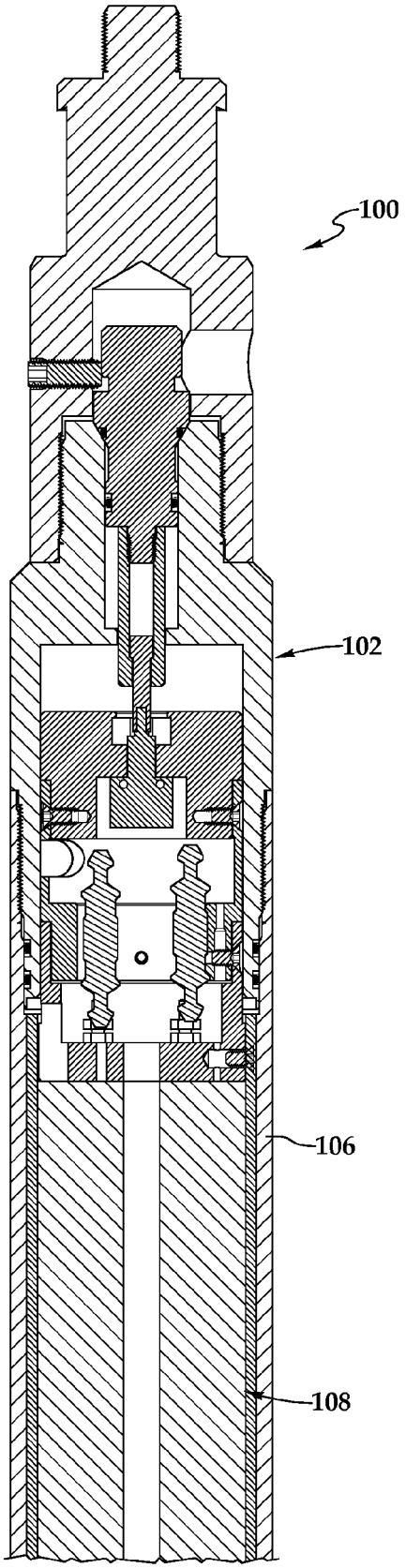
FIGS. 2A-2E are cross sectional views of successive axial sections of a downhole circulating system according to an embodiment of the present invention.
Figure 2B:
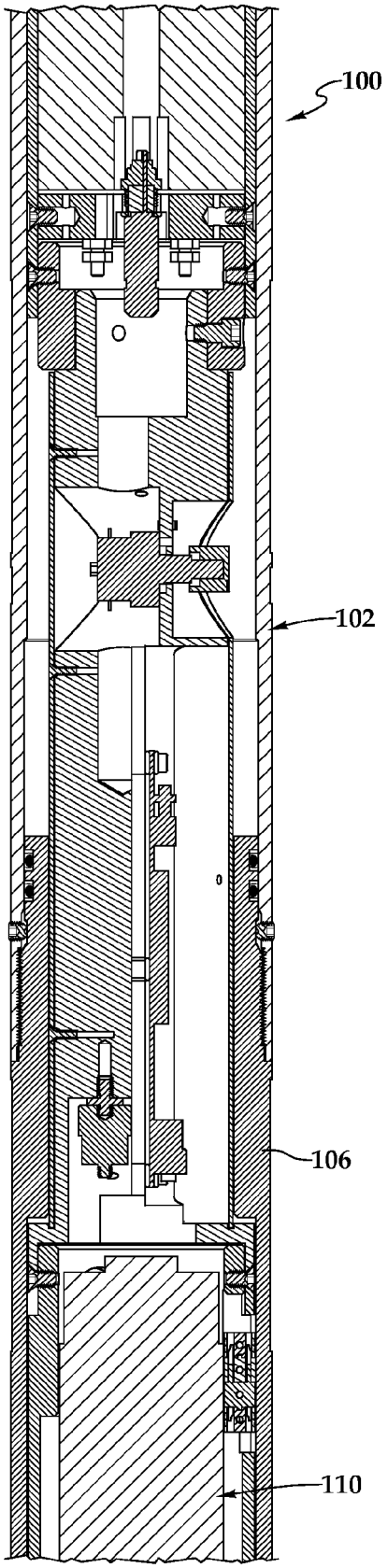
Figure 2C:
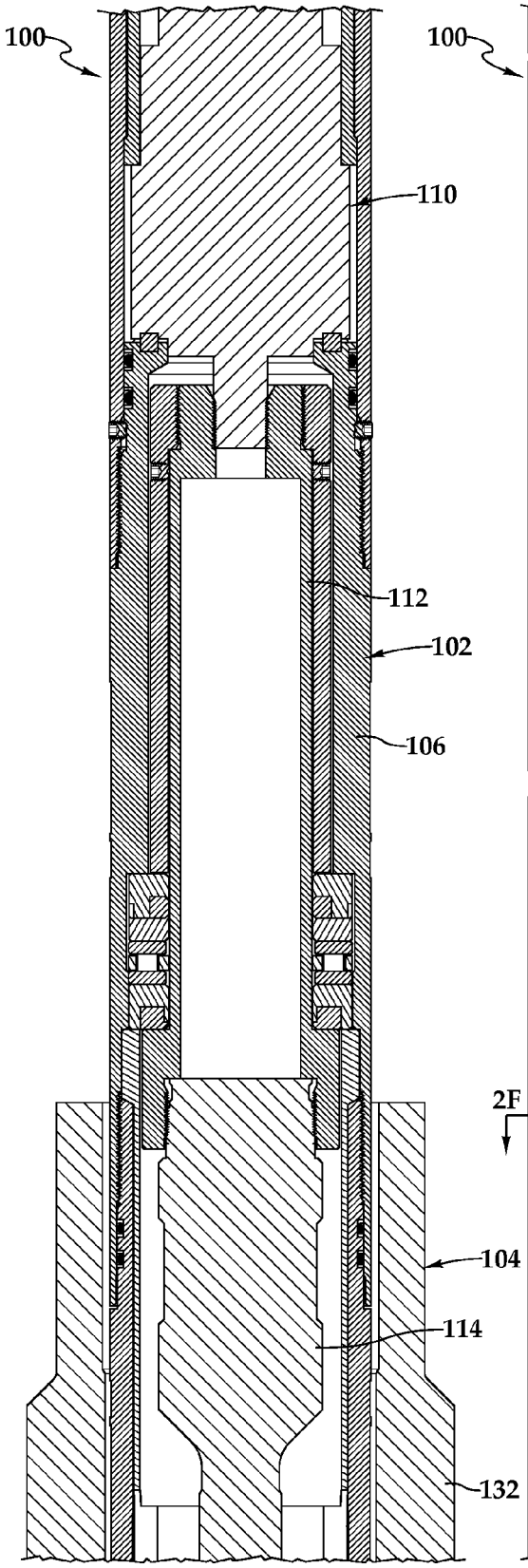
Figure 2D:
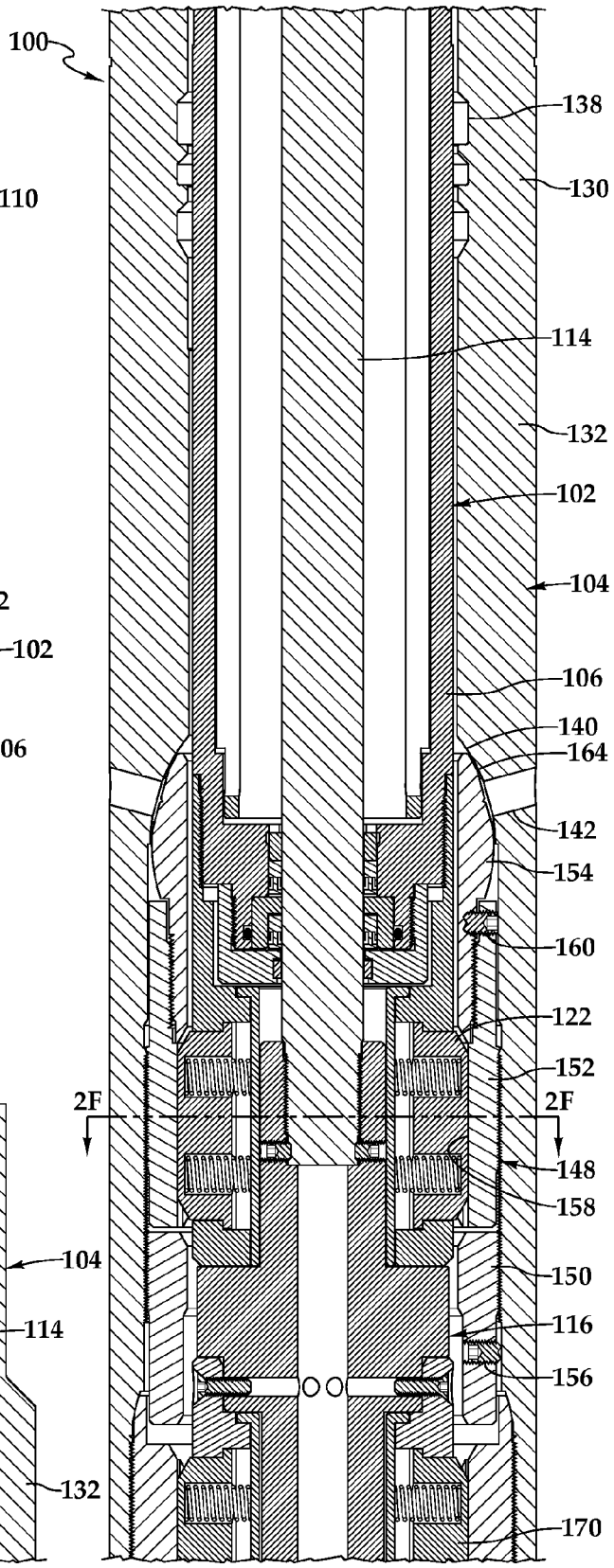
Figure 2E:
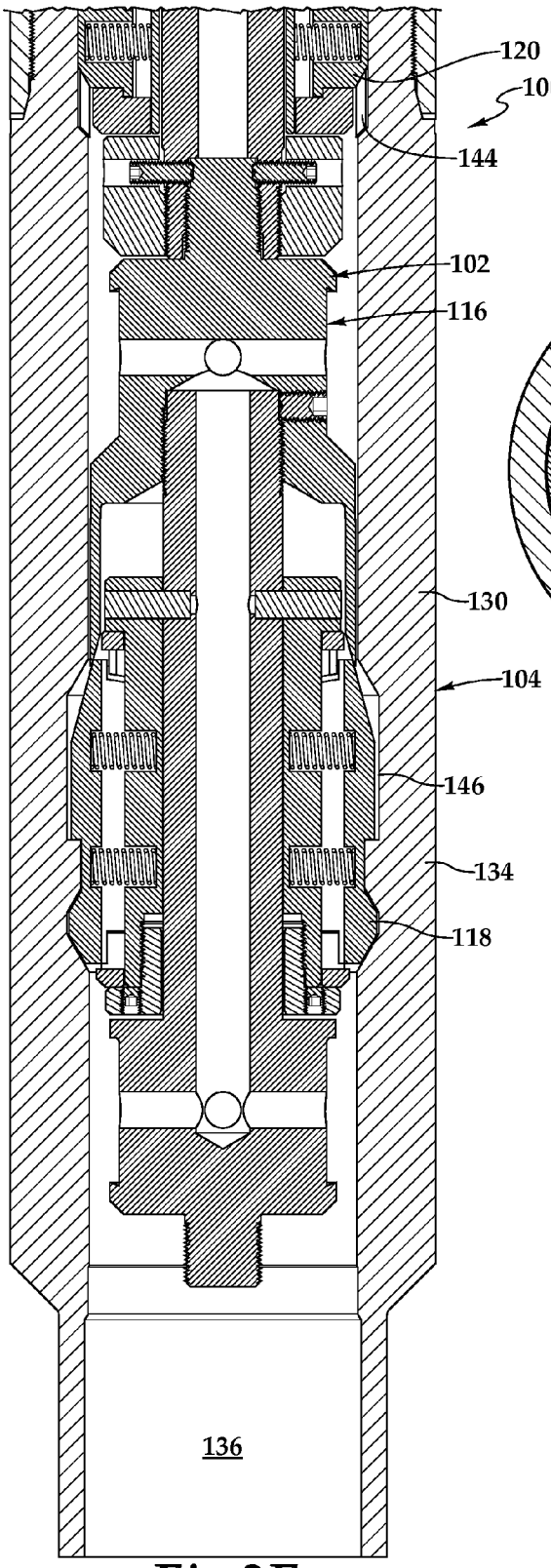
Figure 2F:
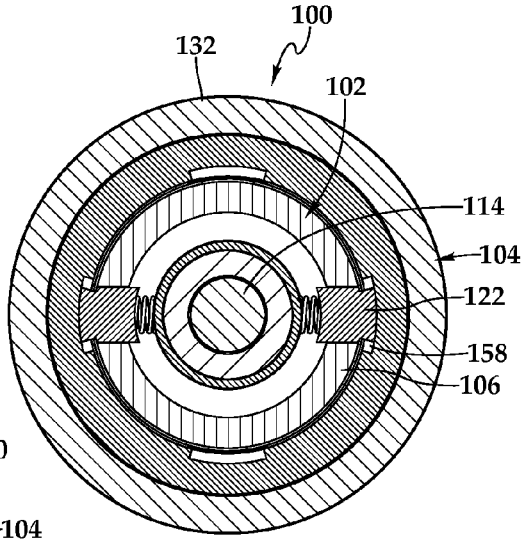
FIG. 2F is a cross sectional view of the downhole circulating system of FIGS. 2A-2E taken along line 2F-2F.

In operation, downhole power unit 102 is adapted to cooperate with circulating valve 104 to enable and disable fluid circulation therethrough. Specifically, after circulating valve 104 has been run downhole as part of a tubing string and it is desired to circulate fluid between the interior of the tubing string and the annulus surrounding the tubing string, downhole power unit 102 is run downhole on a suitable conveyance such as a wireline. Upon reaching the desired depth downhole, downhole power unit 102 engages circulating valve 104. Specifically, engagement assembly 116 interacts with circulating valve 104. First, locating keys 118 engage locating profiles 146 of lower housing section 134. At this point, anti-rotation keys 120 should be axially aligned with anti-rotation profile 144 and torque keys 122 should be axially aligned with rotation profile 158. Slight rotation of rotatable shaft 114 may now be required to engage anti-rotation keys 120 with anti-rotation profile 144 and torque keys 122 with rotation profile 158, as best seen in FIG. 2F. Thereafter, activation of downhole power unit 102 to rotate rotatable shaft 114 will cause upper valve section 152 and head portion 154 to rotate together relative to upper housing section 132.

For example, to operate circulating valve 104 from the non-circulating configuration (FIG. 4) to the circulating configuration (FIG. 3), downhole power unit 102 is activated to rotate in a first direction which rotates upper valve section 152 and head portion 154 relative to upper housing section 132 such that seal elements 168 are rotationally and translationally shifted away from openings 142 and such that ports 166 are substantially aligned with openings 142 enabling fluid communication through circulating valve 104. To operate circulating valve 104 from the circulating configuration (FIG. 3) to the non-circulating configuration (FIG. 4), downhole power unit 102 is activated to rotate in a second direction which rotates upper valve section 152 and head portion 154 relative to upper housing section 132 such that seal elements 168 are rotationally and translationally shifted toward openings 142 until the outer surfaces of seal rings 170, 172 are spherically mated with internal seat 140 to create a metal-to-metal seal around each opening 142 that prevents fluid communication through circulating valve 104. This process can be repeated as desired to operate circulating valve 104 between its circulating and non-circulating configurations. When desired, upward jarring will release downhole power unit 102 from circulating valve 104 and downhole power unit 102 can be retrieved to the surface.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole circulating valve comprising:

a generally tubular outer housing having an axially extending internal passageway including an internal seat and at least one generally radially extending opening formed through the housing intersecting the internal seat; and a valve element rotatably disposed within the internal passageway, the valve element having an axially extending internal bore and a head portion disposed at least partially within the internal seat, the head portion including at least one generally radially extending seal element, the valve element having a first position relative to the housing wherein the at least one seal element is not aligned with the at least one opening allowing fluid communication between the at least one opening and the internal passageway and a second position relative to the housing wherein the at least one seal element is aligned with the at least one opening and wherein the at least one seal element forms a metal-to-metal seal with the internal seat preventing fluid communication between the at least one opening and the internal passageway, wherein, the head portion rotates relative to and translates toward the internal seat to sealingly engage the seal element with the internal seat when the valve element is operated from the first position to the second position, thereby forming the metal-to-metal seal.

2. The downhole circulating valve as recited in claim 1 wherein the internal seat further comprises a spherical segment having a first radius.

3. The downhole circulating valve as recited in claim 2 wherein the at least one generally radially extending opening extends generally in the direction of the first radius.

4. The downhole circulating valve as recited in claim 2 wherein an outer surface of the head portion further comprises a spherical segment having a second radius.

5. The downhole circulating valve as recited in claim 4 wherein the head portion further comprises at least one generally radially extending port that is circumferentially offset from the at least one seal element, wherein, in the first position, the at least one generally radially extending port is in fluid communication with the at least one opening and wherein the at least one generally radially extending port extends generally in the direction of the second radius.

6. The downhole circulating valve as recited in claim 4 wherein the at least one generally radially extending seal element extends generally in the direction of the second radius.

7. The downhole circulating valve as recited in claim 4 wherein the first radius and the second radius are sized to enable spherical mating of the at least one seal element and the internal seat.

8. The downhole circulating valve as recited in claim 1 wherein the at least one seal element further comprises a seal ring having a circular cross section.

9. The downhole circulating valve as recited in claim 1 wherein the at least one seal element further comprises a pair of concentric seal rings each having a circular cross section.

10. The downhole circulating valve as recited in claim 1 wherein the housing further includes a plurality of circumferentially distributed generally radially extending openings formed through the housing intersecting the internal seat, wherein the head portion further includes a plurality of circumferentially distributed generally radially extending ports and a plurality of circumferentially distributed generally radially extending seal elements that are circumferentially offset from the ports and wherein, in the first position, the ports are in fluid communication with the openings and, in the second position, each of the seal elements is aligned with one of the openings and forms a metal-to-metal seal with the internal seat preventing fluid communication between the openings and the internal passageway.

11. A downhole circulating valve comprising:

a generally tubular outer housing having an axially extending internal passageway including a spherical segment internal seat having a first radius and at least one generally radially extending opening formed through the housing intersecting the internal seat; and a valve element rotatably disposed within the internal passageway, the valve element having an axially extending internal bore and a head portion having an outer surface including a spherical segment with a second radius, the head portion translatable relative to and disposed at least partially within the internal seat, the head portion including at least one generally radially extending port and at least one generally radially extending seal element that is circumferentially offset from the port, the valve element having a first position relative to the housing wherein the port is in fluid communication with the opening and a second position relative to the housing wherein the seal element is aligned with the opening and wherein the seal element forms a metal-to-metal seal with the internal seat, wherein, the first radius and the second radius are sized to enable spherical mating of the at least one generally radially extending seal element and the internal seat; and wherein, the head portion rotates relative to and translates toward the internal seat to sealingly engage the seal element with the internal seat when the valve element is operated from the first position to the second position, thereby forming the metal-to-metal seal.

12. The downhole circulating valve as recited in claim 11 wherein the at least one generally radially extending seal element further comprises at least one seal ring having a circular cross section.

13. The downhole circulating valve as recited in claim 11 wherein the housing further includes a plurality of circumferentially distributed generally radially extending openings formed through the housing intersecting the internal seat, wherein the head portion further includes a plurality of circumferentially distributed generally radially extending ports and a plurality of circumferentially distributed generally radially extending seal elements that are circumferentially offset from the ports and wherein, in the first position, the ports are in fluid communication with the openings and, in the second position, each of the seal elements is aligned with one of the openings and forms a metal-to-metal seal with the internal seat.

* * * * *